United States Patent [19]

Hill et al.

[11] 4,026,048

[45] May 31, 1977

[54] MULTIPLE CIRCUIT CONTROL

[75] Inventors: Jack C. Hill, Milwaukee; David E. Bennett, Waukesha, both of Wis.

[73] Assignee: Douglas Dynamics Corporation, Milwaukee, Wis.

[22] Filed: Dec. 31, 1975

[21] Appl. No.: 645,515

[52] U.S. Cl. ..... 37/42 R; 200/4; 200/6 A; 200/16 C; 200/61.86; 361/160

[51] Int. Cl.[2] ..... E01H 5/04; H01H 9/06

[58] Field of Search ..... 37/42 R, 41; 317/123, 317/136, 137; 200/4, 6 A, 6 R, 16 C, 17 R, 153 T, 153 K, 61.86; 307/139, 142, 112

[56] References Cited

UNITED STATES PATENTS

| | | | |
|---|---|---|---|
| 1,550,793 | 8/1925 | Fairbanks | 200/4 |
| 1,716,370 | 6/1929 | Dark et al. | 200/4 X |
| 2,618,693 | 11/1952 | Hay et al. | 317/136 |
| 2,793,259 | 5/1957 | Parsons | 200/6 A |
| 2,849,548 | 8/1958 | Young | 200/6 A |
| 2,941,048 | 6/1960 | Lybrook et al. | 200/153 K X |
| 2,978,549 | 4/1961 | Krueger | 200/16 C X |
| 3,223,792 | 12/1965 | Strother, Jr. | 200/6 A |
| 3,585,319 | 6/1971 | Payerle et al. | 200/6 A |
| 3,666,900 | 5/1972 | Rothweiler et al. | 200/6 A |
| 3,731,013 | 5/1973 | Nightengale | 317/137 X |

*Primary Examiner*—E. H. Eickholt

[57] ABSTRACT

A control lever extends through a cruciform opening in a control box and inside of the box fixed electrical contacts surround its inner end in an array corresponding to the shape of the cruciform opening. A common electrical contact is connected to the lever. Selective movement of the lever into the guideways provided by the cruciform opening selectively completes electrical contact of the common contact with the fixed electrical contacts to energize a desired electrical circuit. The lever is spring biased so that, when the operating force is removed, the lever returns to a neutral position out of engagement with all fixed contacts. A solenoid is selectively engageable with the lever to restrict movement thereof from the neutral position.

16 Claims, 5 Drawing Figures

MULTIPLE CIRCUIT CONTROL

BACKGROUND OF THE INVENTION

This invention relates to multiple circuit controls and, more particularly, to such controls as are used to provide selection of raise, lower, and/or angulation of a vehicle mounted snowplow blade.

Electrically controlled, hydraulically operated snowplow assemblies wherein the plow blade can be selectively raised, lowered, and/or angled right or left are well known. Examples of such a system are found in U.S. Pat. No. 3,307,275 and co-pending application of George D. Simonds, Jr., Ser. No. 645,516, filed Dec. 31, 1975, entitled "Valve and Pump Control for a Hydraulic System", both assigned to the assignee of this application.

Various types of in-cab control arrangements have been proposed for use in such systems and this application is concerned with a control particularly well suited, but not exclusively restricted, to use in such a system.

A general object of this invention is to provide a readily manipulated control which insures positive movement into one of a plurality of available control positions; other, more specific objects are to provide that control versatility in a relatively simple structure, a structure which permits of ease of maintenance and replacement of parts, and a structure in which a safety interlock can be easily incorporated to prevent inadvertent operation.

SUMMARY OF THE INVENTION

For the achievement of these and other objects, this invention proposes a control box having an outer housing in which an opening is provided which is characterized by a plurality of linear portions radiating from a common, preferably central open area. A control lever extends through the opening and is associated with a biasing member urging the lever so that it normally assumes a neutral position in the central area of the housing opening. Inside of the housing, fixed electrical contacts are arranged around the lever in an array corresponding to the shape of the housing opening with at least one such contact being provided for each linear portion thereof. A common electrical contact is in contact with the lever throughout the range of lever movement to make selective electrical circuits through the fixed contacts. This arrangement permits the lever to assume a normal, neutral position wherein all electrical circuits are open and to be moved selectively into the linear portions of the opening to enable one of a plurality of available operable circuits, in the preferred embodiment raise, lower, and angulation right or left.

A locking arrangement is provided for selectively engaging and restricting control lever movement. In the preferred embodiment this locking arrangement is connected in the ignition circuit and, when the ignition is off, normally engages the lever preventing movement to all positions except that corresponding to the raised position. When the ignition switch is turned on, the circuit to unlock the lever is enabled and the lever is released for movement. A second switch can be provided which must also be closed to free the lever even after the ignition switch is closed.

The lever functions as a momentary switch control and returns to its neutral position as soon as the operating force is removed. To convert the lever to a holding switch control a detent mechanism can be provided in one or more of the linear portions of the opening to hold the lever and require a positive force to return it to the neutral position.

A resilient boot, of rubber or the like, extends between the lever and housing to seal the opening without interfering with lever movement.

Other objects and advantages will be pointed out in, or be apparent from, the specification and claims, as will obvious modifications of the embodiment shown in the drawings, in which:

DESCRIPTION OF THE PREFERRED EMBODIMENT

Figure 1:
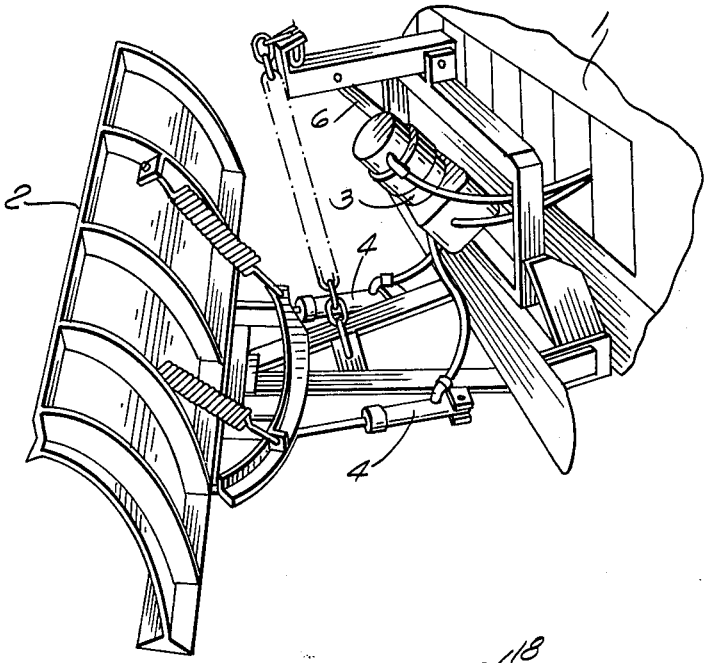
FIG. 1 is a perspective view of a vehicle mounted snowplow blade.
Figure 2:
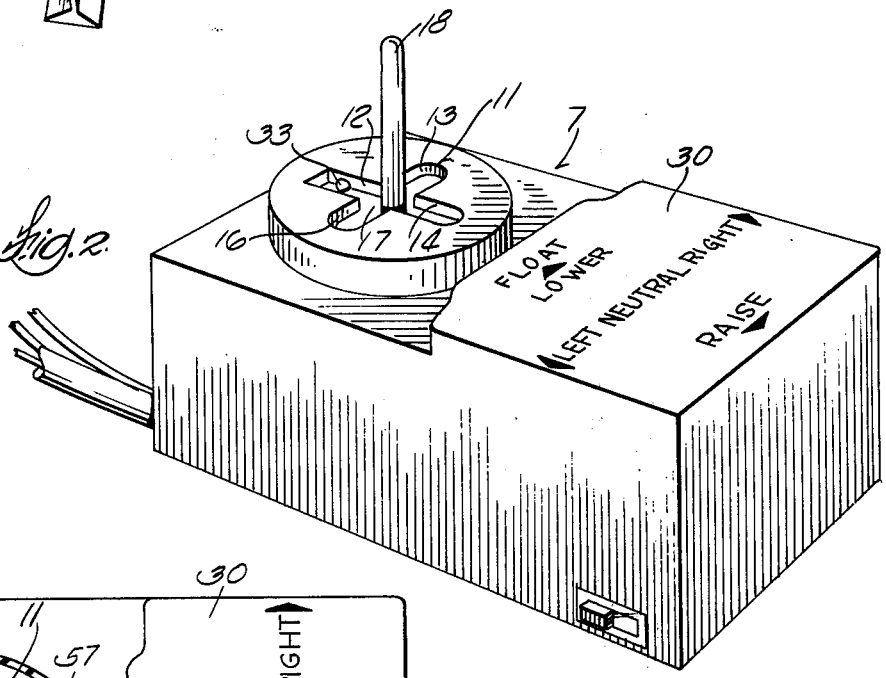
FIG. 2 is a perspective view of a control box embodying this invention and with the rubber boot removed.
Figure 5:
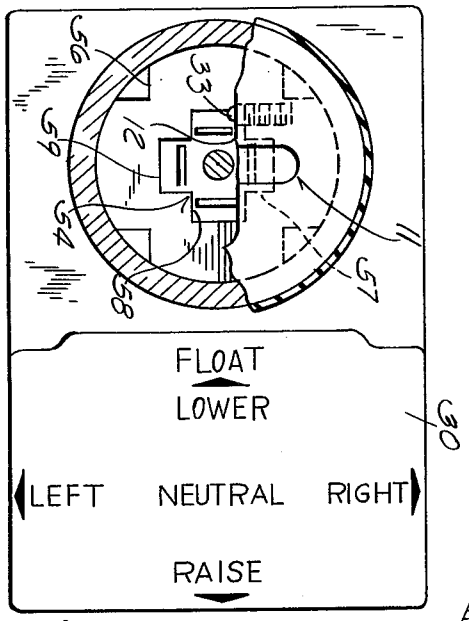
FIG. 5 is a top plan view of the control box with portions broken away.
Figure 3:
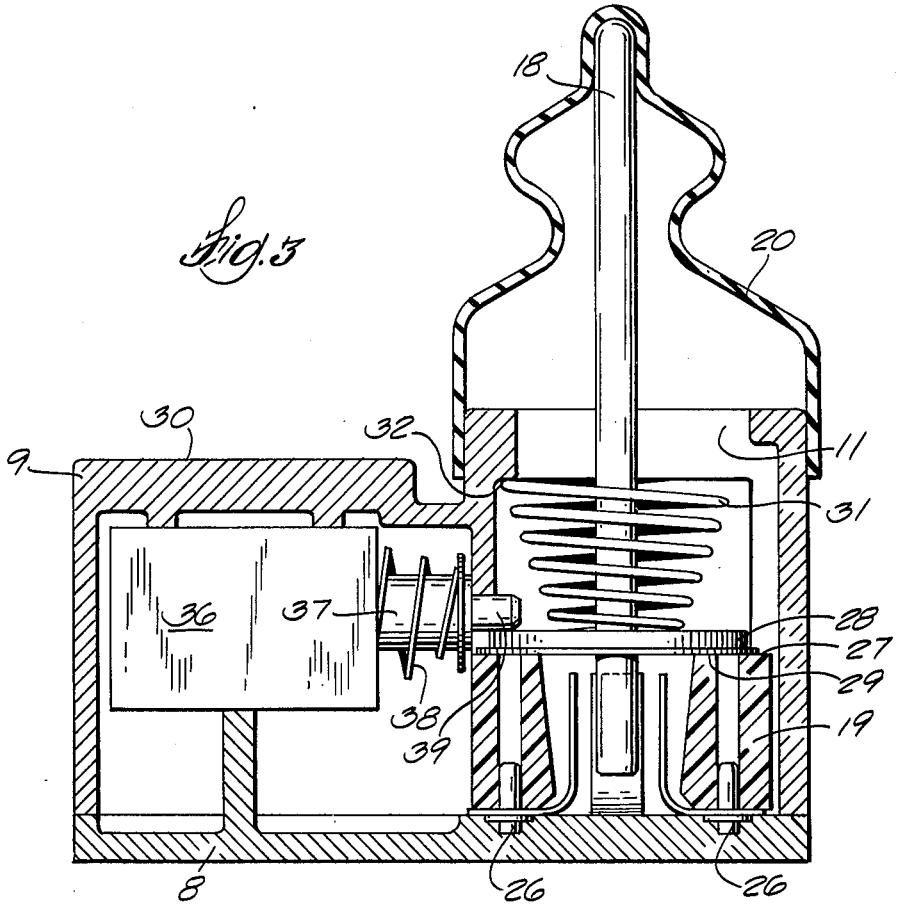
FIG. 3 is a section view through the control box.
Figure 4:
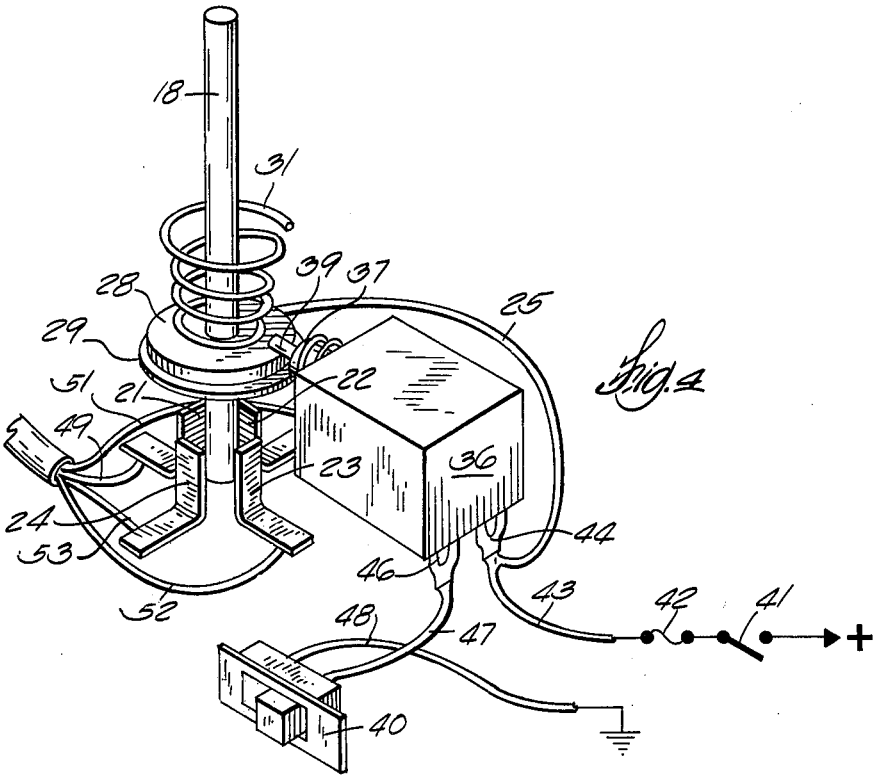
FIG. 4 is a perspective view of the control box with the outer housing removed.

The invention will be described as embodied in an hydraulically operated vehicle mounted snowplow.

More particularly, vehicle 1 carries a plow blade 2 through a conventional support arrangement. A power unit 3 mounted on the front of the vehicle provides the power source for the hydraulic system which activates rams 4 and 6. Angulation of the plow blade 2 is achieved by selective manipulation of rams 4 and the plow blade is raised and lowered through operation of lift ram 6. The embodiment to this point is generally conventional so far as this invention is concerned and should additional details of the installation be required, reference may be had to the aforementioned U.S. Pat. No. 3,307,275 and/or pending application.

In accordance with standard practice, a control for the blade system is provided in the vehicle cab (not shown). The control includes box 7 having a housing made of a base 8 and a cover 9 detachably connected to the base.

An opening 11 is provided in the cover and is made up of a plurality of linear portions 12, 13, 14, and 16, all radiating from a common, generally central area 17. Preferably, the opening 11 has a cruciform configuration.

Control lever 18 extends through opening 11. A cylindrical member 19 is detachably connected to housing base 8 and is positioned in the interior of the housing. A number of electrical contact members 21, 22, 23, and 24, are connected to cylindrical member 19 by rivets 26, the assembly of the electrical contacts 21–24 and the cylindrical member 19 being supported from base 8. Contacts 21, 22, 23, and 24 provide a plurality of relatively fixed electrical contacts within the control box housing and surround the inner end of lever 18 in an array corresponding generally to the orientation of the linear portions 12, 13, 14, and 16 of opening 11.

Cylindrical member 19 defines a ledge 27 at its upper, free end. Control lever 18 is provided with a flange 28 which is generally annular and attached to lever 18, the lever and flange both being made of electrically conductive material. Flange 28 projects laterally from the longitudinal axis of lever 18 and engages an annular electrical contact disc 29 which rests on ledge 27 so that the flange engages the ledge through the contact disc.

A conical spring 31 extends between a shoulder 32 provided on housing cover 9 and generally surrounding opening 11. The spring 31 extends from that shoulder to flange 28 and provides a biasing force urging the flange 28 into engagement with contact 29, trapping it between the flange and the ledge and, moreover, positively urging lever 18 into a neutral position wherein it is generally located in common area 17 of opening 11 and with its inner end spaced from all of the fixed contacts 21–24.

With this arrangement, the exposed end of lever 18 can be moved selectively into one of the linear portions 12, 13, 14, and 16 of opening 11 and this will move the inner end of the lever into engagement, respectively, with either fixed contact 21, 22, 23, or 24 depending upon which linear guideway the lever is moved into. Flange 28 rolls on disc 29 with a nutating type motion to maintain a closed electrical circuit.

In the preferred embodiment and as shown by the notations on the upper surface 30 of the control box housing, the guideways correspond to various operative modes of the plow blade. More specifically, movement into guideway 12 lowers the plow blade, movement into guideway 13 angles the plow blade to the right, movement into guideway 14 raises the plow blade, and movement into guideway 16 angles the plow blade to the left. When the operating force on lever 18 is released, the conical spring 31 will automatically return the operating lever to its neutral position and interrupt whatever engagement had been made with the fixed contacts thereby opening the control circuits.

The arrangement discussed to this point provides for momentary control of the four available operations. It is possible to adapt the control for sustained operation in either one or more of the modes of operation. Generally, it may be desirable to provide sustained operation in the "lower" mode so that the plow blade will float over irregularities in the surface being worked. To this end, a detent screw 33 is inserted into the cover 9 so that its tip projects into guideway 12. With this arrangement, lever 18 is forceably pushed past the tip of screw 33 and is held in that position unless it is physically returned by the operator past the tip toward the neutral position. This sustained operation load it provided in the "lower" mode of operation since in that mode hydraulic pressure is relieved from the lift system and the plow blade is allowed to float up and down to accommodate irregularities in the area being worked.

A resilient boot, of rubber material or the like, extends over the upper exposed end of the lever and tightly engages the lever and the housing cover 9 around opening 11. The rubber boot seals the interior of the control box from dust and dirt without interfering with lever movement and also acts as an electrical insulation to reduce the risk of the operator contacting electrically live parts.

The fixed contacts 21–24 are connected by conventional circuit wires to various solenoid operators (not shown) controlling conventional hydraulic valves (not shown) to control the system hydraulic circuit and provide the various modes of operation discussed above. Contact disc 29 is connected by lead 25 to a power circuit, to be described more completely hereinafter. Thus, when the inner end of control rod 18 makes selective engagement with one or the other of fixed contacts, an electric circuit is completed from lead 25 through disc 29, flange 28 and a portion of the control lever and one of the fixed contacts to an appropriate solenoid to accomplish the desired function.

In order to prevent inadvertent operation of the plow blade, it is desirable to provide some means of locking the control against operation. In the preferred embodiment, this is provided by a solenoid assembly 36 which has a plunger 37 biased by spring 38 into a position, when the solenoid is de-energized, such that plunger tip 39 engages flange 28 holding the flange firmly against the ledge 27. When the solenoid is energized, plunger tip 39 is withdrawn against the bias of spring 38 freeing the flange and thus the control lever for free movement. When the plunger tip 39 is in engagement with lever 28, the lever can only be manipulated into guideway 14 establishing a "raise" mode of operation which does not present any particular hazard. But, it cannot move into any of the other three guideways.

The electrical circuit for the solenoid includes ignition switch 41 for the vehicle and also a secondary control on/off switch 40. Both the ignition switch and the control switch are in the circuit for the solenoid so that both switches have to be closed before the solenoid is energized to release the lever for operation.

Ignition switch 41 is connected to the plus side of the vehicle battery and through fuse 42 and lead 43 to one solenoid terminal 44 and lead 25. Solenoid terminal 46 is connected through leads 47 and 48 and switch 40 to ground. To complete the electrical circuit for the power unit, contacts 21, 22, 23, and 24 are connected to operative devices such as electrical solenoids by leads 49, 51, 52, and 53 and then to ground.

The described structure provides a reliable control in a relatively simple structure. Moreover, it will be noted that by removing cover 9, which is attached to the base by screws, all of the interior parts of the control are readily accessible for whatever maintenance or replacement may be required from time to time.

Another feature in the control adding to the reliability and ease of maintenance is the specific contact mounting structure. It will be noted that member 19 includes a central opening 54 which, similar to opening 11, is also generally cruciform in shape. More generally, it corresponds in configuration with the opening 11. Contacts 21–24 are L-shaped members with the portion contacting the levers being located within the openings 56, 57, 58, and 59 and the lever again being located, when in its neutral position, in a central, common area 61. With this arrangement, when the assembly consisting of a cylindrical member and the fixed contacts is attached to the base, the fixed contacts are automatically oriented relative to opening 11 for proper function.

Although but one embodiment of the present invention has been illustrated and described, it will be apparent to those skilled in the art that various changes and modifications may be made therein without departing from the spirit of the invention or from the scope of the appended claims.

We claim:

1. A control box comprising, in combination, a housing, means defining an opening in said housing including a plurality of generally linear portions radiating from a common, generally central area so that said linear portions define a plurality of guideways radiating from said common area, lever means extending through said opening into the interior of said housing, means defining a laterally extending, generally annular flange on said lever means, means defining a plurality of fixed electrical contact means within said housing and surrounding said lever means in an array corresponding generally to the orientation of said guideways relative to each other, means defining a shoulder within said housing, means supporting said lever means in said housing and including biasing means urging said flange into engagement with said shoulder and urging said lever means into a normal position extending generally through said common area and spaced from said fixed contacts and further supporting said lever means for selective movement, against said biasing means, into one of said guideways for selective engagement with at least one of said fixed contacts, electrical circuit means including common electrical contact means extending over said shoulder and between said shoulder and said flange, said flange nutating on said common contact means as said lever is moved into said guideways, and said lever means having an electrically conductive portion, including said flange, which selectively engages said fixed contacts as said lever means moves in said guideways for establishing selective electrical circuits with the fixed contacts as the fixed contacts are selectively engaged by said electrically conductive lever portion.

2. The control box of claim 1 further including locking means selectively moveable into and out of engagement with lever means to respectively restrict movement of said lever means from said common area and to free said lever means for movement.

3. The control box of claim 2 wherein said combination is connected to a vehicle mounted system for raising, lowering and angling a plow blade and wherein said locking means includes an electrical circuit, said vehicle includes an ignition switch, said ignition switch is connected in the electrical circuit of said locking means, and said locking means holds said lever means in engagement with said shoulder to restrict movement of said lever means when the electrical circuit to said locking means is open and is out of engagement with said lever means when the electrical circuit to said locking means is completed.

4. The control box of claim 3 wherein said locking means comprises a solenoid including a normally extending plunger which is retracted when said solenoid is energized, and said plunger, when extended, engages said flange and holds said flange against said shoulder.

5. The control box of claim 4 wherein said opening has a generally cruciform shape.

6. A control box comprising, in combination, a housing, means defining an opening in said housing including a plurality of generally linear portions radiating from a common, generally central area so that said linear portions define a plurality of guideways radiating from said common area, an elongated lever extending through said opening, means defining a laterally extending, generally annular flange on said lever, at least one fixed electrical contact for each of said guideways, said fixed electrical contacts disposed within said housing and surrounding said lever in an array corresponding to the orientation of said guideways, means defining a shoulder within said housing, spring means extending between said housing and flange and biasing said flange into engagement with said shoulder and biasing said lever into a normal position wherein it is disposed in said common area and spaced from said fixed electrical contacts, means supporting said lever for selective movement against said bias into one of said guideways for selective engagement of said lever with said fixed contacts, an electrical circuit means including common electrical contact means extending over said shoulder and between said shoulder and said flange, said flange nutating on said common contact means as said lever is moved into said guideways, and said lever means having an electrically conductive portion, including said flange, which selectively engages said fixed contacts as said lever means moves in said guideways, for establishing selective electrical circuits with the fixed contacts as they are selectively engaged by said electrically conductive lever portion.

7. The control box of claim 6 wherein said housing includes a base, including means on said base comprising a member detachably connected to said base and having a free end which defines said shoulder and an opening generally in alignment with said housing opening, wherein said housing further includes a cover detachably connected to said base and having said housing opening provided therein, and wherein said fixed contacts are located in said member opening and said lever extends into said member opening.

8. The control box of claim 7 wherein said housing opening and said member opening are generally cruciform in shape having relatively aligned guideway portions extending from relatively aligned central, common areas, and said fixed electrical contacts are positioned in an exposed to said lever from the guideway portions of said member.

9. The control box of claim 8 including detent means in one of said housing opening guideways engageable with the lever when it is located in said guideway to prevent return movement of lever to said neutral position by said spring.

10. The control box of claim 8 wherein said combination is connected to a vehicle mounted system for raising, lowering and angling a plow blade and including a locking means having an electrical circuit, said vehicle includes an ignition switch, said ignition switch is connected to the electrical circuit of said locking means, and said locking means holds said lever in engagement with said shoulders to restrict movement thereof when the electrical circuit to said locking means is open and is out of engagement with said lever means when the electrical circuit to said locking means is completed.

11. The control box of claim 10 wherein said locking means comprises a solenoid including a normally extending plunger which is retracted when said solenoid is energized, and said plunger, when extended, engages said flange and holds said flange against said shoulder.

12. A control box connected in a vehicle mounted system for raising, lowering and angling a plow blade and comprising, in combination, a housing including means defining a shoulder within said housing, means defining an opening in said housing including a plurality of generally linear portions radiating from a common, generally central area so that said linear portions define a plurality of guideways radiating from said common area, generally elongated lever means extending through said opening into the interior of said housing, means defining a plurality of fixed electrical contact means within said housing and surrounding said lever means in an array corresponding generally to the orientation of said guideways relative to each other, means supporting said lever means in said housing and including spring biasing means urging said lever means into a normal position extending generally through said common area and spaced from said fixed contacts and further supporting said lever means for selective movement, against said spring biasing means, into one of said guideways for selective engagement with at least one of said fixed contacts, means defining a laterally extending, generally annular flange on said lever means, said spring biasing means extending between said housing and said flange and biasing said flange against said housing shoulder, a common electrical contact disc on said shoulder on which said flange nutates as said lever means is moved selectively into said guideways, electrical circuit means including said common electrical contact disc for establishing an electrical circuit with the fixed contacts as the fixed contacts are selectively engaged by said lever means, locking means selectively movable into and out of engagement with said lever means to respectively restrict movement of said lever means from said common area and to free said lever means for movement, said locking means being electrically operable, said vehicle including an ignition switch connected in the electrical circuit of said locking means, and said locking means holding said lever means flange in engagement with said shoulder to restrict movement of said lever means when the electrical circuit to said locking means is open and is out of engagement with said lever means when the electrical circuit to said locking means is completed.

13. A control box of claim 12 wherein said locking means comprises a solenoid including a normally extending plunger which is retracted when said solenoid is energized, and said plunger, when extended, engages said flange and holds said flange against said shoulder.

14. A control box of claim 13 wherein said housing opening has a generally cruciform shape.

15. A control box connected in a vehicle mounted system for raising, lowering and angling a plow blade and comprising, in combination, a housing including a base and a cover detachably connected to said base, means defining an opening in said housing cover generally cruciform in shape having a plurality of generally linear portions radiating from a common, generally central area so that said linear portions define a plurality of guideways radiating from said common area, an elongated lever extending through said housing opening into the interior of said housing, means on said base in the form of a member detachably connected to said base and having an opening generally cruciform in shape defined by linear guideway portions extending from a generally central, common area, said guideway portions and said central common areas of said housing opening and said member opening being relatively aligned, at least one fixed electrical contact for each of said housing opening guideways, said electrical contacts positioned in and exposed to said lever from the guideway portions of said member and surrounding said lever in an array corresponding to the orientation of said guideways, said lever extending into said member opening, said member having a free end and said free end defining a shoulder generally surrounding a portion of said lever, means defining a generally annular, laterally extending flange on said lever, spring means extending between said housing and said flange to bias said flange into engagement with said shoulder and also biasing said lever into a normal position wherein it is disposed in said common central area of said housing opening and spaced from said fixed electrical contacts, said lever being selectively movable against said bias into one of said guideways of said housing opening for selective engagement of said lever with said fixed contacts, said spring means also biasing said lever flange into engagement with said shoulder, electrical circuit means including common contact means operatively associated with said lever for establishing an electrical circuit with the fixed contacts as they are selectively engaged by said lever, locking means selectively movable into and out of engagement with said lever to respectively restrict movement of said lever from said common area and to free said lever for movement into said guideways, said locking means being electrically operable, said vehicle including an ignition switch connected in the electrical circuit of said locking means, and said locking means holding said lever flange in engagement with said shoulder to restrict movement thereof when the electrical circuit to said locking means is open and is out of engagement with said lever when the electrical lever to said locking means is completed.

16. The control box of claim 15 wherein said locking means comprises a solenoid including a normally extending plunger which is retracted when said solenoid is energized, and said plunger, when extended, engages said flange and holds said flange against said shoulder.

* * * * *